US006457750B1

(12) United States Patent
Sokurenko et al.

(10) Patent No.: US 6,457,750 B1
(45) Date of Patent: Oct. 1, 2002

(54) DRAW LATCH

(75) Inventors: William E. Sokurenko, Glen Mills; Eric D. Hyp, Aspers, both of PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/596,919

(22) Filed: Jun. 19, 2000

Related U.S. Application Data

(63) Continuation-in-part of application No. 09/233,759, filed on Jan. 20, 1999, now Pat. No. 6,076,865.

(51) Int. Cl.[7] ..... E05C 5/00
(52) U.S. Cl. ..... 292/113; 292/DIG. 49
(58) Field of Search ..... 292/66, 67, 109, 292/113, 114, 246, 247, DIG. 49

(56) References Cited

U.S. PATENT DOCUMENTS

| | | | | |
|---|---|---|---|---|
| 1,184,439 A | | 5/1916 | Giles | |
| 1,406,090 A | | 2/1922 | Schermuly | |
| 2,477,472 A | | 7/1949 | Wright | |
| 2,784,994 A | | 3/1957 | Hopkins | |
| 2,829,912 A | | 4/1958 | Koch | |
| 2,966,706 A | | 1/1961 | Christensen | |
| 3,237,978 A | | 3/1966 | Swanson | |
| 3,384,402 A | | 5/1968 | Swanson | |
| 3,490,805 A | | 1/1970 | Di Pierro et al. | |
| 3,526,422 A | | 9/1970 | Trotter | |
| 3,619,995 A | | 11/1971 | McLean | |
| 4,540,206 A | | 9/1985 | Frame et al. | |
| 4,830,413 A | | 5/1989 | Bisbing | |
| 5,271,649 A | | 12/1993 | Gromotra | |
| 5,607,195 A | | 3/1997 | Antonnucci | |
| 5,732,987 A | * | 3/1998 | Wright et al. | 292/113 |
| 6,076,865 A | * | 6/2000 | Sokurenko et al. | 292/113 |

OTHER PUBLICATIONS

Southco, Inc. "Latches and Access Hardware," North American Edition—48 NA, ISO 9001, pp. H2–H43.

* cited by examiner

*Primary Examiner*—Christopher P. Schwartz
(74) *Attorney, Agent, or Firm*—Paul & Paul

(57) ABSTRACT

A draw latch for latching together two closure members having an open and a closed position and having a keeper, a base bracket, a housing, and a clevis, the keeper secured to one of the closure members, the a base bracket attached to the other of the closure members, the a housing having a first end and a second end, the first end of the housing pivotally and detachably connected to the keeper, the a clevis having a first and a second end, the first end of the clevis pivotally secured to the base bracket, and the second end of the clelvis pivotally secured to the second end of the housing; and the draw latch having secondary catches to secure the draw latch in the open and/or closed position.

3 Claims, 15 Drawing Sheets

DRAW LATCH

CROSS-REFERENCE TO RELATED APPLICATION

This application is a continuation-in-part U.S. patent application Ser. No. 09/233,759, filed Jan. 20, 1999 now U.S. Pat. No. 6,076,865.

BACKGROUND OF THE INVENTION

This invention relates to draw latches for latching together two closure members. The latch is referred to as a "draw latch" because it forcibly draws together the two members on which the latch members are mounted. Such members may be components of a cabinet, a case, a housing for a machine, or any type of enclosure. In many cases, the closure members will be co-planar panels. But in other cases, the two closure members will be angularly disposed, such as at an angle to each other, for example, at right angles, or when used to close a "pop-open" style window in an automobile.

Draw latches are essentially toggle latches having three links and three pivot points. One of the pivot points is disengageable so that the latch may be unlatched to separate the closure members.

The present invention relates particularly to a draw latch of the toggle type. A unique aspect of this invention is special features that allow the latch to be held firmly in place by secondary catching features in a fully open position and/or a fully closed position.

Numerous draw latches are in the prior art, including U.S. Pat. No. 4,540,206 to Frame et al., the complete specification of which is incorporated by reference herein.

SUMMARY OF THE INVENTION

The draw latch of the present invention is for latching together two closure members. The draw latch has an open and a closed position and has a keeper secured to one of the closure members, a bracket attached to the other of the closure members, and a housing having a first end and a second end with the first end of the housing pivotally and detachably connected to the keeper, and a clevis having a first and a second end. The first end of the clevis is pivotally secured to the bracket, and the second end of the clevis is pivotally secured to the second end of the housing.

The housing has a secondary catch means to secure the draw latch in the open position. In addition to or instead of the secondary catch means to hold the latch in the open position, the housing may have a second secondary catch means to secure the draw latch in the closed position.

It is therefore an object of the present invention to provide an improved draw latch that has a secondary catch means to secure the latch in either an open and/or a closed position.

It is a further object of the present invention to provide an improved draw latch that has a secondary catch means to secure the latch in either an open and/or a closed position, where the secondary catch means is a detent in the housing.

Other objects and advantages of the present invention will become apparent from the following description taken in conjunction with the accompanying drawings.

DETAILED DESCRIPTION OF THE PREFERRED EMBODIMENT

Figure 1:
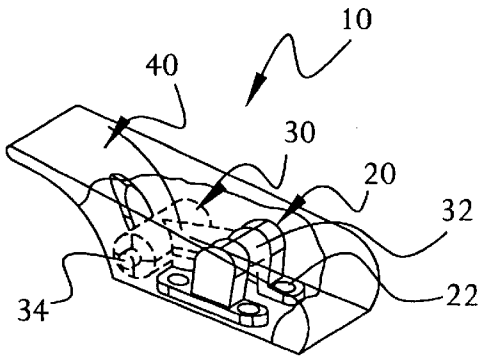
FIG. 1 is a perspective, partially cutaway view of the draw latch of a preferred embodiment of the present invention, with the latch in the closed position.
Figure 2:
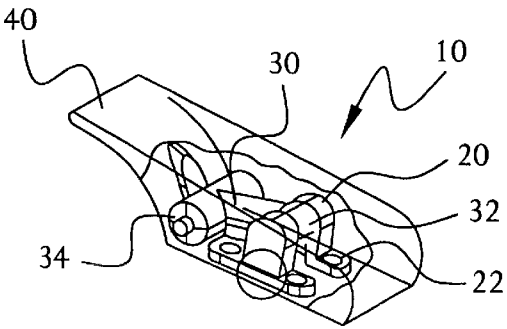
FIG. 2 is a perspective, partially cutaway view of the draw latch of FIG. 1, with the latch in the closed position.
Figure 3:
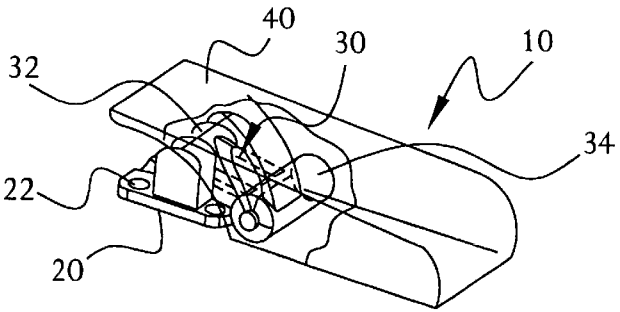
FIG. 3 is a perspective, partially cutaway view of the draw latch of FIG. 1, with the latch in the open position.
Figure 4:
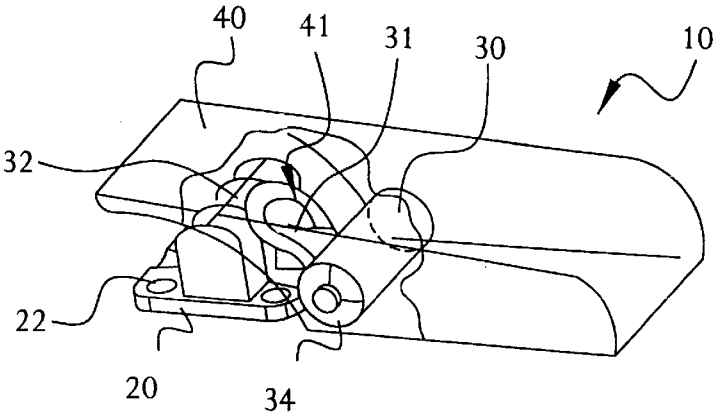
FIG. 4 is a perspective, partially cutaway view of the draw latch of FIG. 1, with the latch in the open position.
Figure 5:
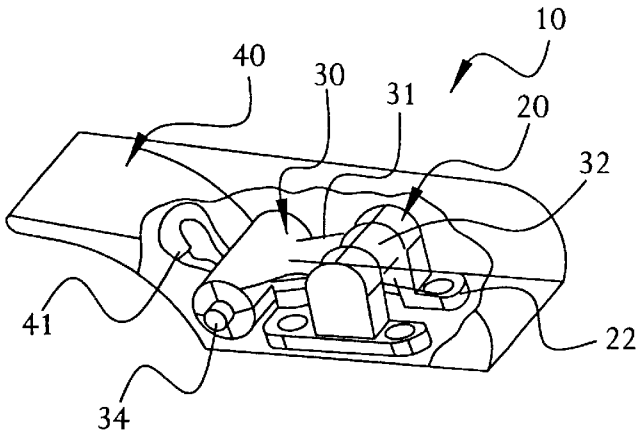
FIG. 5 is a perspective partially cutaway view of the draw latch of FIG. 1, with the latch in the closed position.
Figure 6:
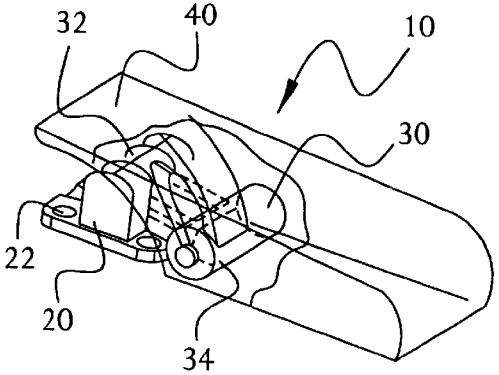
FIG. 6 is a perspective, partially cutaway view of the draw latch of FIG. 1, with the latch in the open position.
Figure 7:
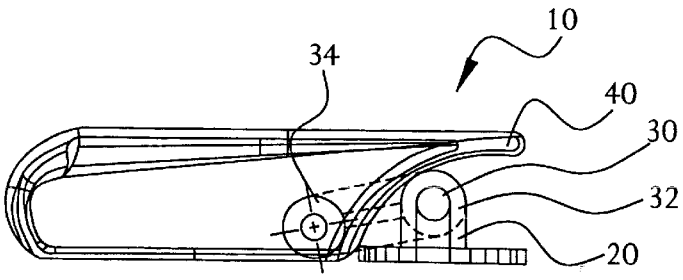
FIG. 7 is a side elevation view of the draw latch of FIG. 1, with the latch in the open position.
Figure 8:
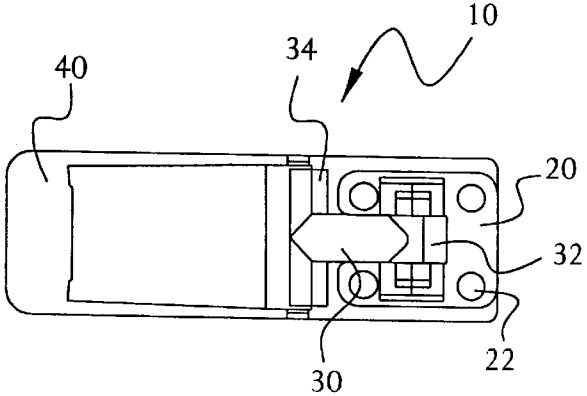
FIG. 8 is a bottom view of the draw latch of FIG. 1, with the latch in the open position.
Figure 9:
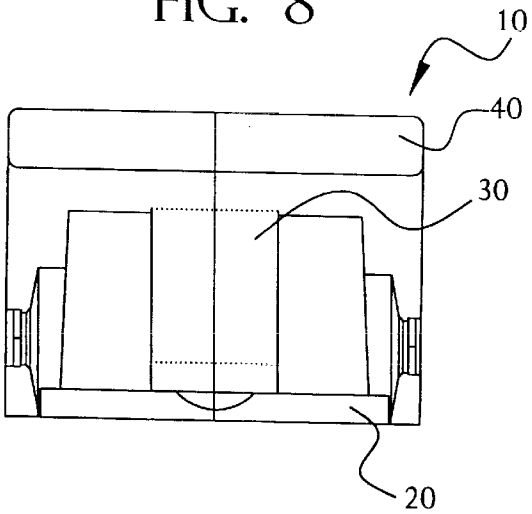
FIG. 9 is a rear elevation view of the draw latch of FIG. 1, with the latch in the open position.
Figure 10:
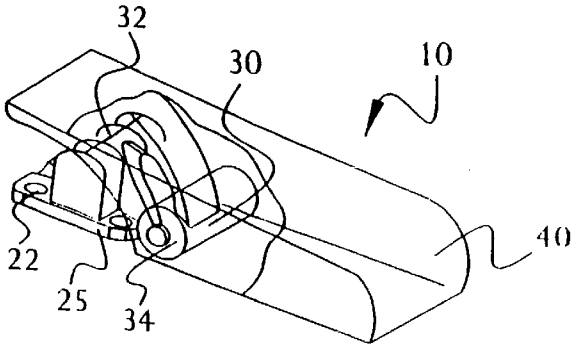
FIG. 10 is a perspective, partially cutaway view of the draw latch of FIG. 1, with the latch in the open position.
Figure 11:
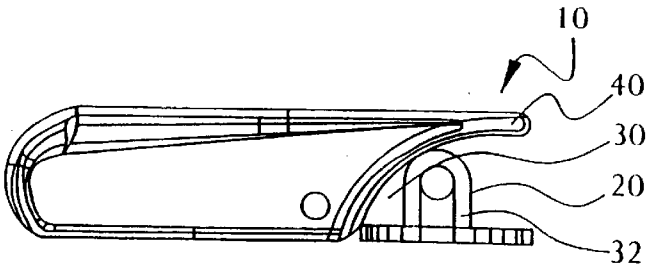
FIG. 11 is a side elevation view of the draw latch of FIG. 1, with the latch in the open position.
Figure 13:
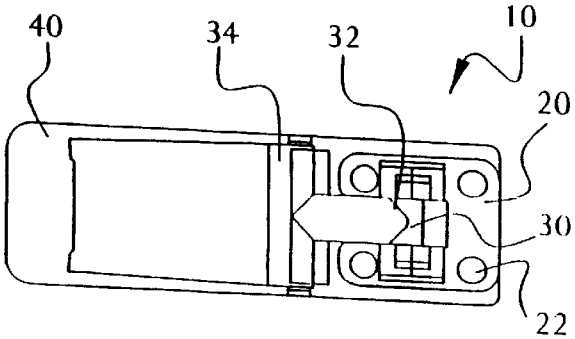
FIG. 13 is a bottom view of the draw latch of FIG. 1, with the latch in the open position.
Figure 12:
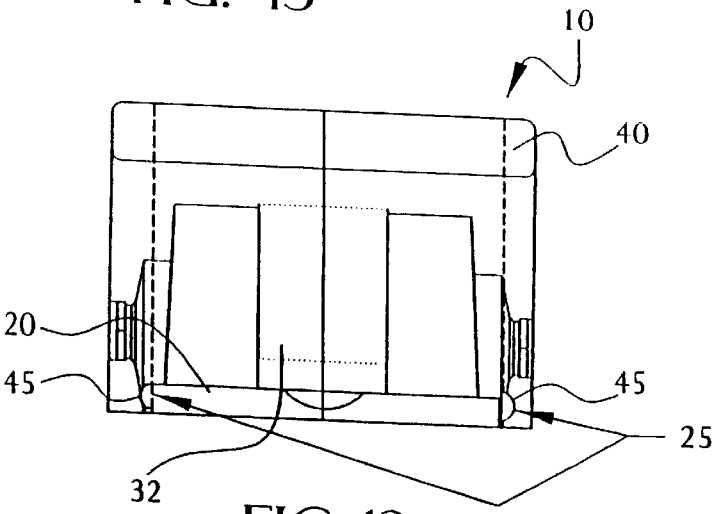
FIG. 12 is a rear elevation view of the draw latch of FIG. 1, with the latch in the open position.
Figure 14:
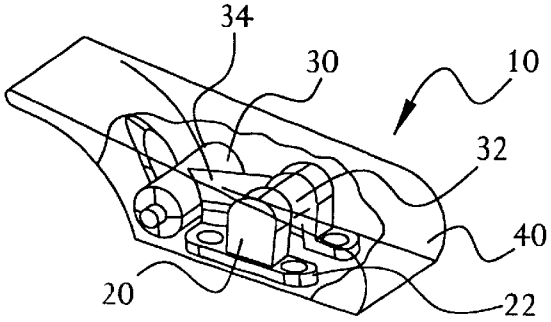
FIG. 14 is a perspective, partially cutaway view of the draw latch of FIG. 1, with the latch in the closed position.
Figure 15:
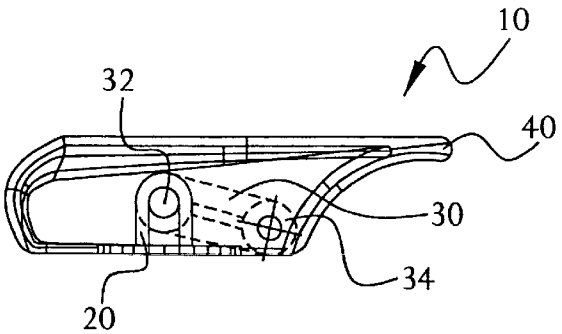
FIG. 15 is a side elevation view of the draw latch of FIG. 1, with the latch in the closed position.
Figure 16:
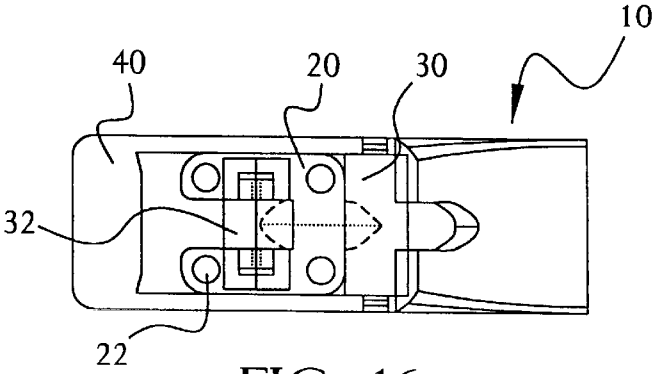
FIG. 16 is a bottom view of the draw latch of FIG. 1, with the latch in the closed position.
Figure 17:
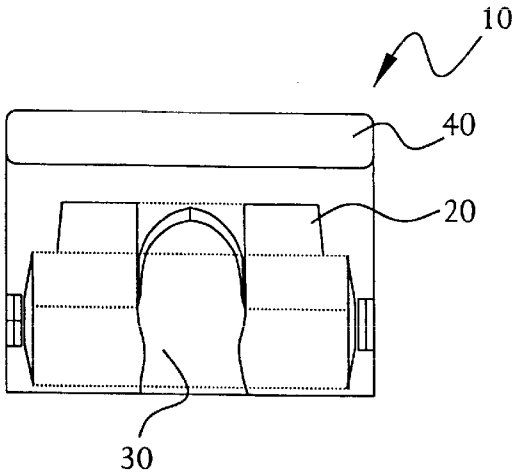
FIG. 17 is a rear elevation view of the draw latch of FIG. 1, with the latch in the closed position.

Referring now in detail to the drawings wherein like reference numbers indicate like elements throughout the several views, there is shown in FIGS. 1 through 21 a draw latch 10 in a open or closed position in accordance with one preferred embodiment of the present invention. The illustrative device is shown generally comprising a base bracket 20, a clevis 30, and a housing 40. The keeper 50 is shown for example in FIG. 22 (also clearly depicted as item 21 in U.S. Pat. No. 4,540,206, incorporated herein by reference). The keeper 50 is attached to one closure member 60 as is known in the art, for example, as a keeper for a flip-out style automobile window. Base bracket 20 is secured to another closure member 70, for example, by rivets 23 through holes 22. A first end 32 of clevis 30 is pivotally attached to base bracket 20 such that it is free to swing in an arc of, for example, about 180 degrees. The second end 34 of clevis 30 is pivotally attached to housing 40 in a manner known in the art, as depicted in U.S. Pat. No. 4,540,206.

All of the component parts of the draw latch 10 of the present invention are preferably molded of engineering plastic with the resilience necessary for assembly and use of the components.

Figure 22:
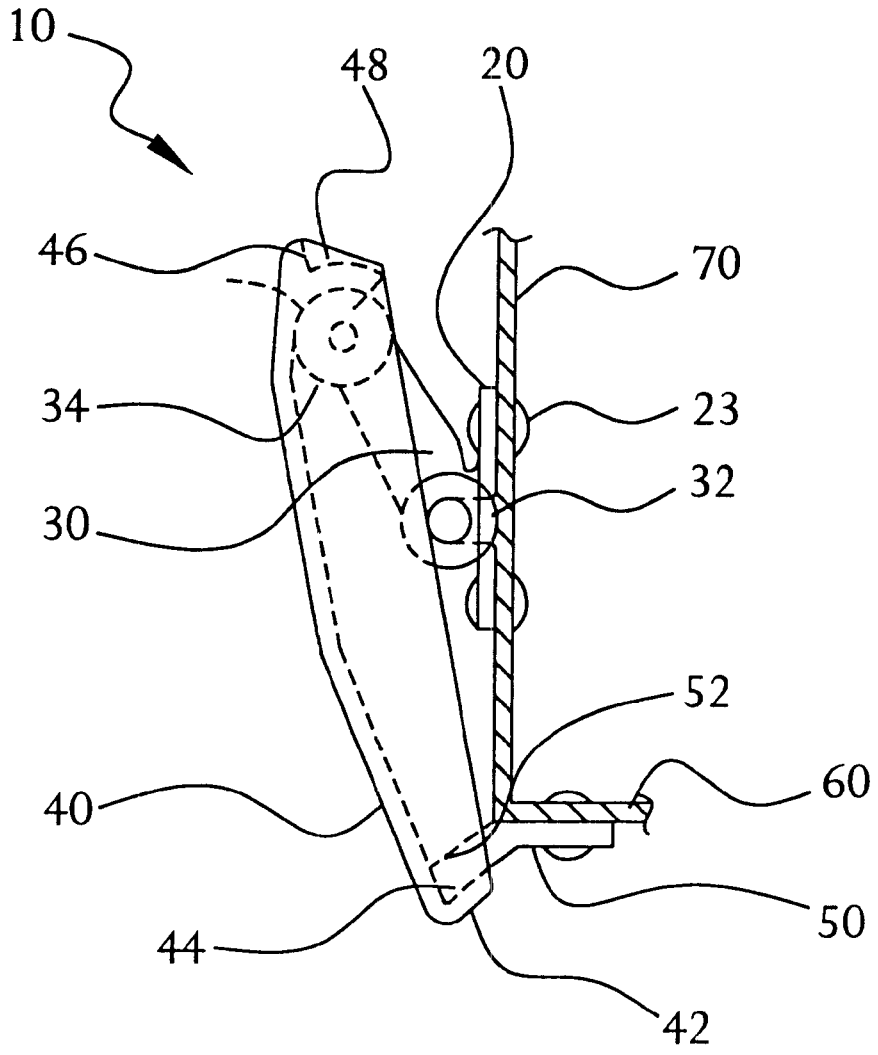
FIG. 22 is a side view of the latch, depicted as mounted on a closure member, being moved in the direction of the arrow toward a fully latched position to draw together and to latch two closure members which are at right angles to one another.
Figure 23:
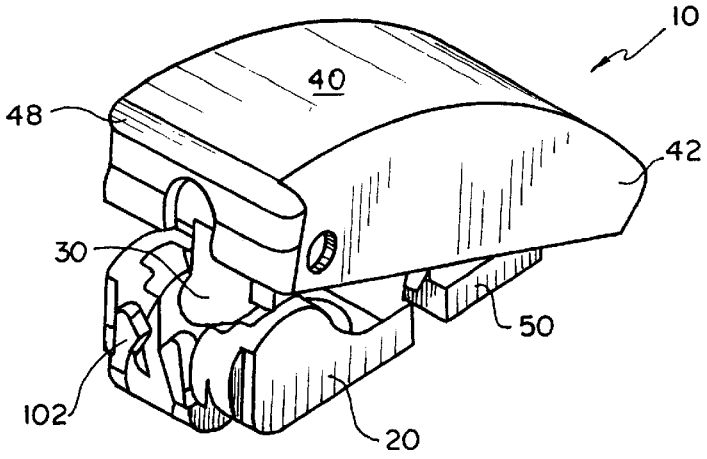
FIG. 23 is a perspective view of a second embodiment of a draw latch according to the present invention, showing the latch in its open position.
Figure 24:
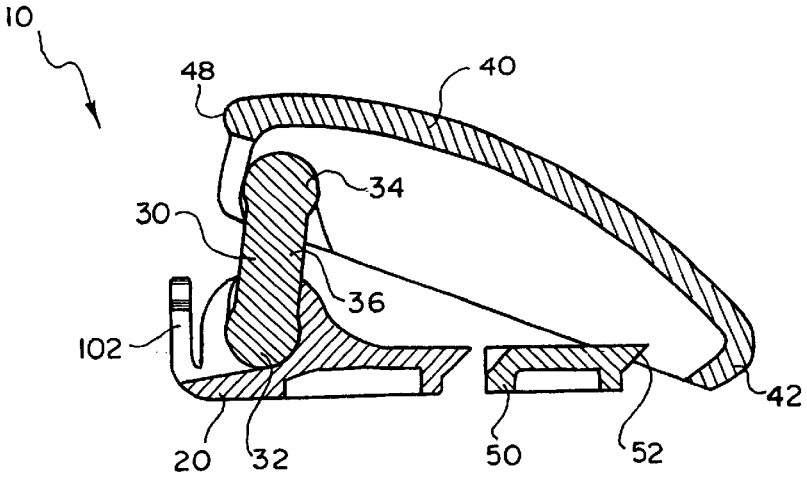
FIG. 24 is a side cross sectional view of a second embodiment of a draw latch according to the present invention, showing the latch in its open position.
Figure 25:
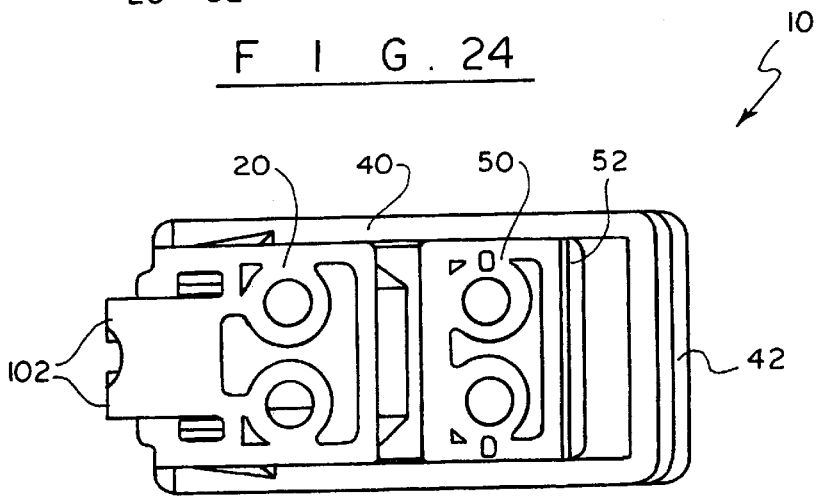
FIG. 25 is a bottom view of a second embodiment of a draw latch according to the present invention.

As seen in FIG. 22, the draw latch 10 is shown about to be moved, for example, by manually applying a light force to the end of the housing 40 in the direction of the arrow A toward a fully latched position. The tip of the hooked nose portion 42 at the lower end of the housing 40 is in detachable engagement with the keeper 50 and the inner radius 44 of the hook portion 42 is about to engage the corresponding outer radius of lip 52 of keeper 50.

When the latch 10 is moved from a position which is on the open side of the "on-center" position to the "over-center" fully latched position, the second end 34 of the clevis 30 bears against the inner radius of the upper end of the housing 40. Thus, in the fully latched position, the pivoting joints are positioned in an over center arrangement characteristic of toggle mechanisms.

To unlatch the latch 10, an outward force is applied manually to the upper end 46 of the housing 40, as by placing the fingers under the flange 48.

As indicated, important new features of the present invention are the features which hold the latch in an open position and/or a closed position. As can be seen in particular in FIG. 4 where the draw latch of the present invention is held in the open position, it can be seen that an internal surface of the housing 40 has a keyhole shaped slot 41. This slot acts as a detent such that the main longitudinal shaft of the clevis 30 snaps into place in the keyhole slot 41 to retain the housing 40 in an open position.

Figure 18:
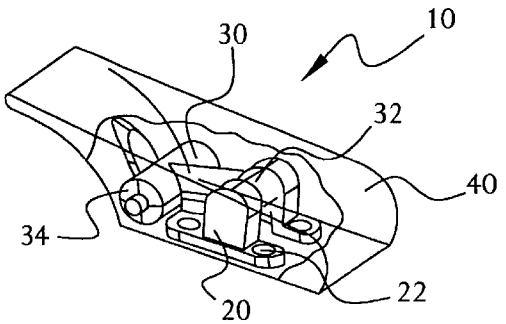
FIG. 18 is a perspective partially cutaway view of the draw latch of FIG. 1, with the latch in the closed position.
Figure 19:
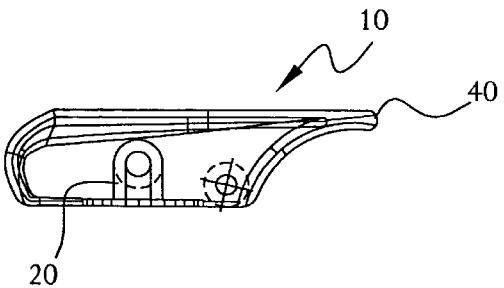
FIG. 19 is a side elevation view of the draw latch of FIG. 1, with the latch in the closed position.
Figure 20:
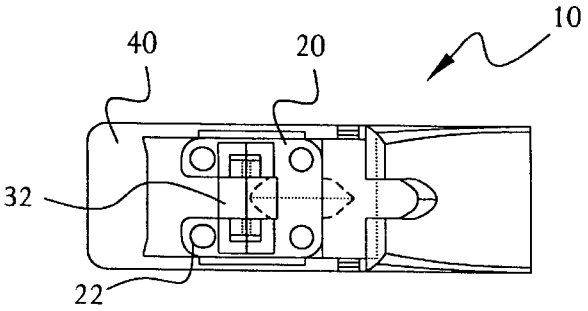
FIG. 20 is a bottom view of the draw latch of FIG. 1, with the latch in the closed position.
Figure 21:
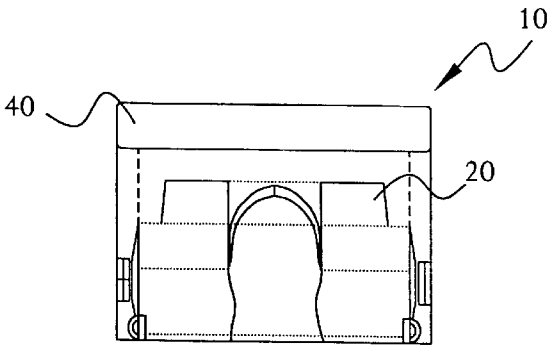
FIG. 21 is a rear elevation view of the draw latch of FIG. 1, with the latch in the closed position.

Additionally, and/or alternatively, another feature adds additional security to hold the latch in the closed position, or acts to hold the latch in a closed position even if a second closure member to which a keeper is attached is not in position. As seen in FIGS. 18 and 21 where the latch is in the closed position (and also in FIGS. 10 and 12 where the latch is in the open position), outwardly protruding detent surface 25 on the base bracket 20 mates with a groove 45 extending along the inner surface of the housing 40 such that when the handle 40 is in a fully closed position, whether or not the handle 40 has engaged a keeper, the handle snaps into position and is held in place by the mating detent surface 25 and groove 45.

FIGS. 23–27, 31–35, and 39–42 illustrate a second embodiment of the latch 10. As in the first embodiment, the second embodiment includes a base bracket 20, a clevis 30, a housing 40, and a keeper 50.

Figure 31:
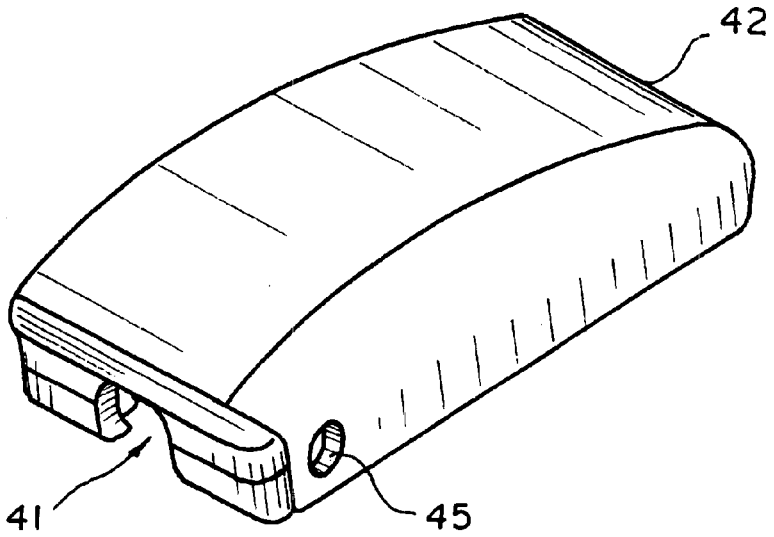
FIG. 31 is a perspective view of a cover for a second and third embodiment of a draw latch according to the present invention.
Figure 32:
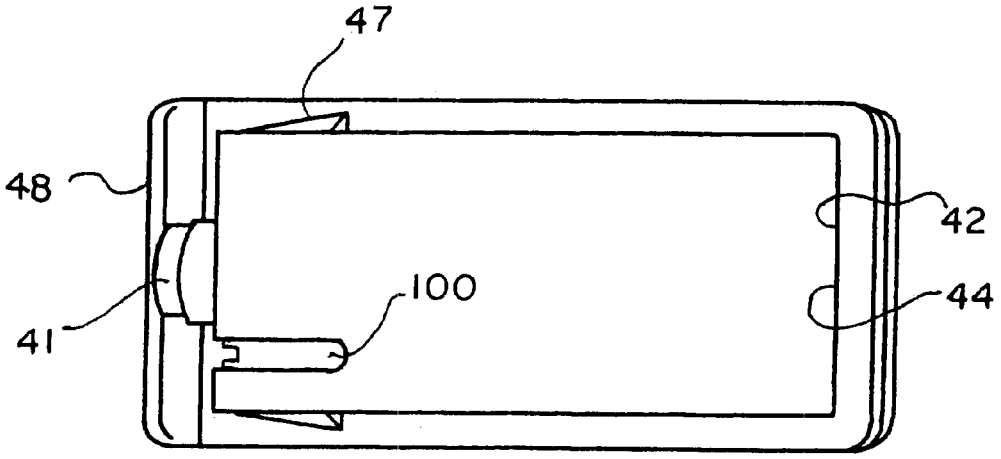
FIG. 32 is a bottom view of a cover for a second and third embodiment of a draw latch according to the present invention.

Referring to FIGS. 31–32, the housing 40 is illustrated. The housing includes a hooked nose portion 42, defining an inner radius 44. The housing's rear includes a slot 41, dimensioned and configured to contain a clevis 30, and a flange 48, dimensioned and configured to permit grasping the flange 48 to raise the housing 40. The rear portion of the housing 40 preferably also defines means for pivotally securing a clevis 30, preferably holes 45, which may include ramped surfaces 47 to facilitate snapping the clevis 30 into place. A rib 100 protrudes from the inside of the top of housing 10, illustrated in FIG. 32.

Figure 33:
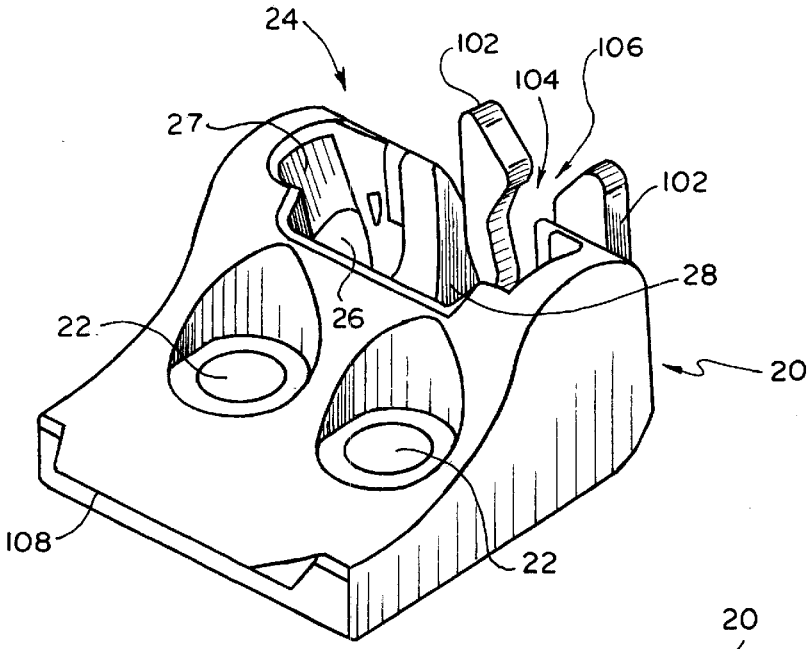
FIG. 33 is a perspective view of a base for a second embodiment of a draw latch according to the present invention.
Figure 34:
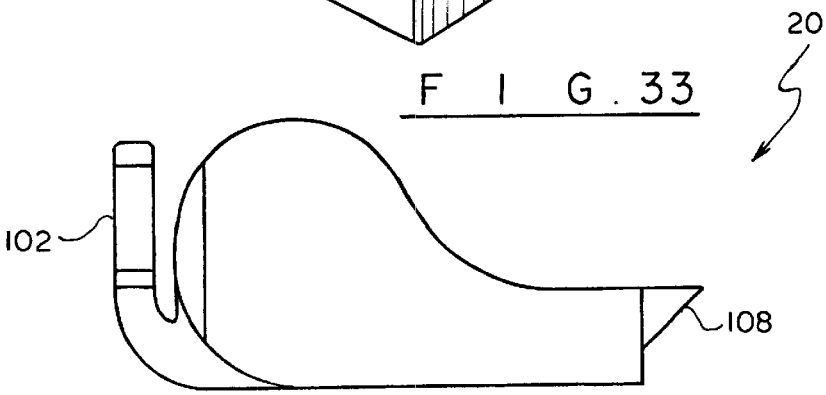
FIG. 34 is a side view of a base for a second embodiment of a draw latch according to the present invention.
Figure 35:
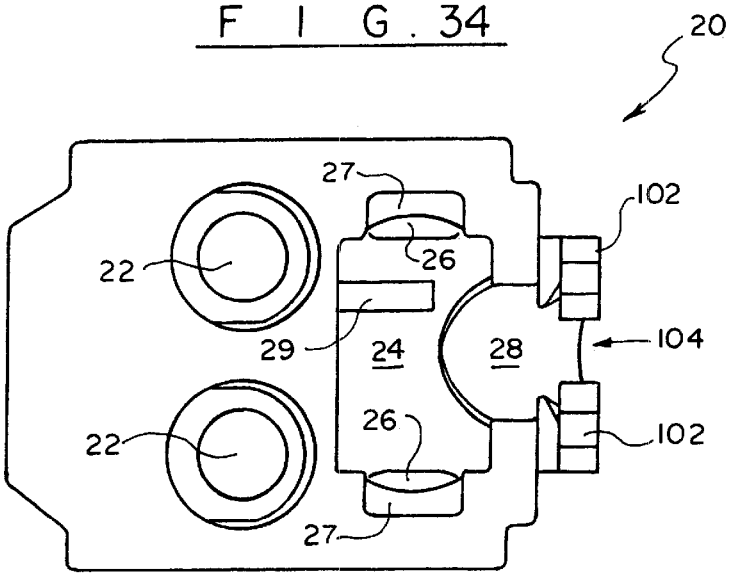
FIG. 35 is a bottom view of a base for a second embodiment of a draw latch according to the present invention.

The base bracket 20 is best illustrated in FIGS. 33–35. The base bracket 20 defines at least one hole 22, dimensioned and configured to receive mounting means such as the rivets 23, described above. The base bracket 20 also includes means for pivotally securing the clevis 30, preferably by defining an opening 24, having a hole or depression 26 on either side. A ramped surface 27 may extend from the top of the base bracket 20 to the holes 26, facilitating snapping in the clevis 30. A slot 28, communicating with the opening 24, is located at the rear of the base bracket 20 and is dimensioned and configured to receive the clevis 30. A rib 29 preferably protrudes into the opening 23. The base bracket 20 may also include a ramped front surface 108.

The rear of the base bracket 20 may include a secondary catch for retaining the clevis, which preferably includes a pair of arms 102, defining a vertical slot 104 therebetween. The vertical slot 104 narrows at its top opening 106. The vertical slot 104 is dimensioned and configured to receive the clevis 30, but to allow the clevis 30 to pass through the top opening 106 only by flexing the arms 102 outward.

Figure 39:
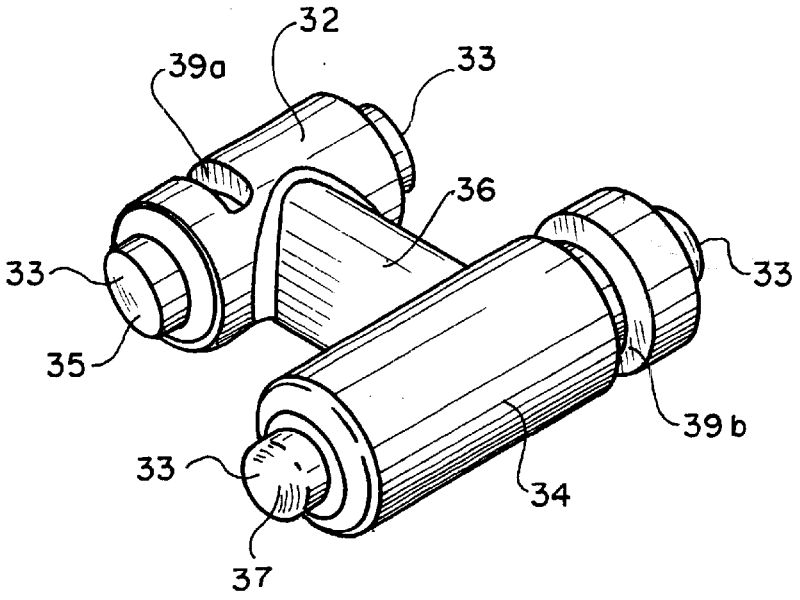
FIG. 39 is a perspective view of a levis for a second and third embodiment of a draw latch according to the present invention.
Figure 40:
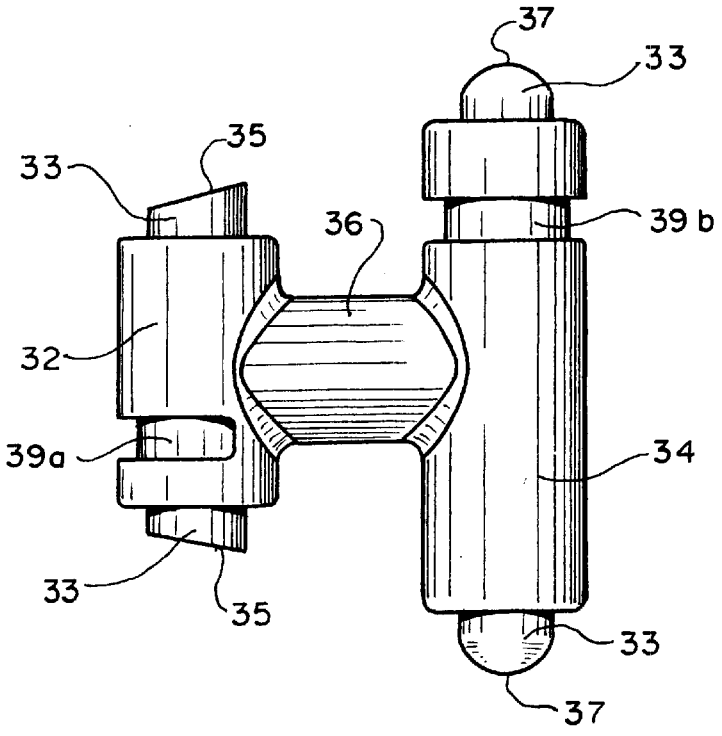
FIG. 40 is a top view of a clevis for a second and third embodiment of a draw latch according to the present invention.

Referring to FIGS. 39–40, a clevis 30 is illustrated. The clevis 30 includes a first end 32, dimensioned and configured to pivotally attach to a base bracket 20, and a second end 34, dimensioned and configured to pivotally attach to the housing 40. A main longitudinal shaft 36 connects the ends 32,34. The first end 32 and second end 34 each include means for pivotally securing the clevis 30, which are preferably pegs 33. The pegs 33 preferably have a ramped surface 35 or curved surface 37 to facilitate snapping the clevis 30 into a base bracket 20 or housing 40. The first end may include a channel 39*a* dimensioned and configured to mate with the rib 29 of the base bracket 20. Likewise, the second end 34 may include a channel 39*b,* dimensioned and configured to mate with the rib 100 of the housing 40. The interaction between the ribs 29,100 and the channels 39*a*,39*b* creates friction, thereby securing the latch in any desired position.

Figure 41:
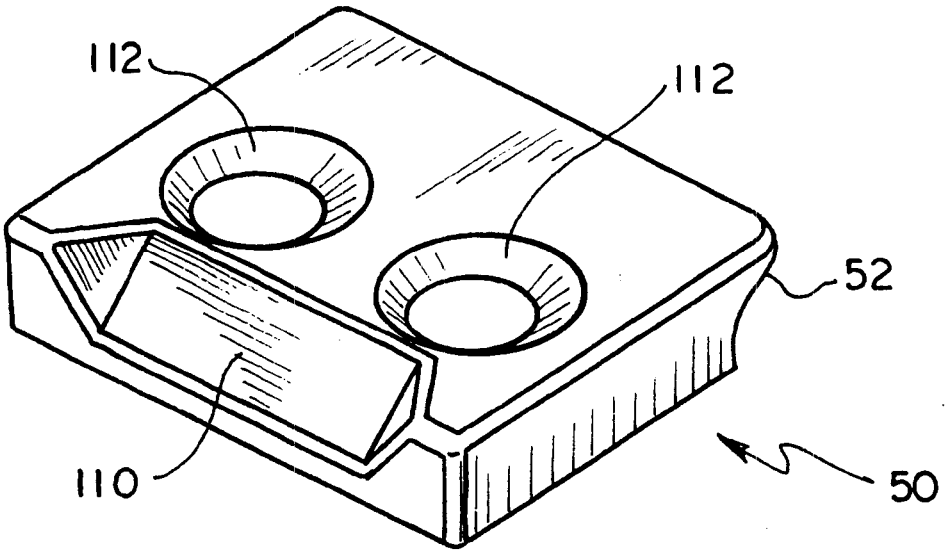
FIG. 41 is a perspective view of a keeper for a second and third embodiment of a draw latch according to the present invention.
Figure 42:
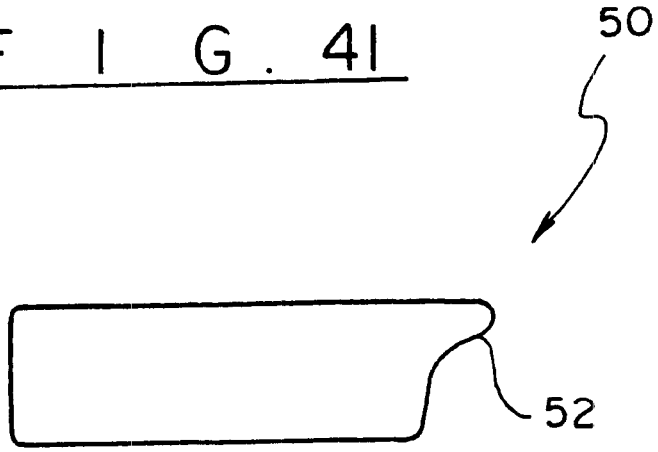
FIG. 42 is a side view of a keeper for a second and third embodiment of a draw latch according to the present invention.

Referring to FIGS. 41–42, a keeper 50 is illustrated. The keeper 50 includes a lip 52, dimensioned and configured to mate with the hooked nose portion 42 of the housing 40. The keeper also preferably includes a ramped surface 110, dimensioned and configured to abut the ramped front surface 108 of the base bracket 20 when the latch 10 is closed. The keeper 50 may include at least one mounting hole 112.

Figure 26:
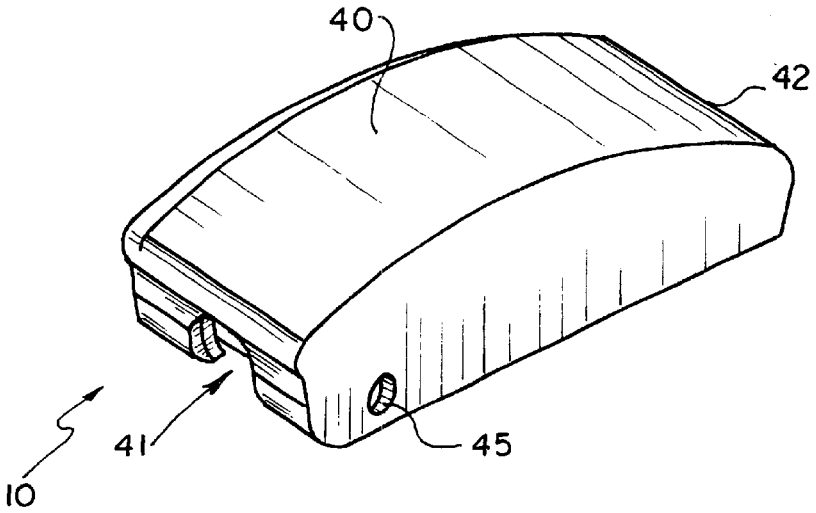
FIG. 26 is a perspective view of a second embodiment of a draw latch according to the present invention, showing the latch in its closed position.
Figure 27:
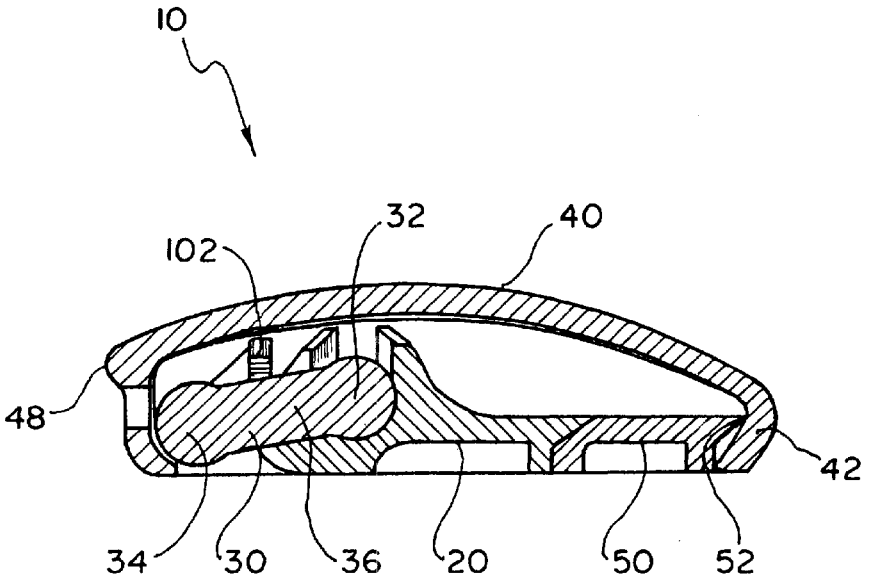
FIG. 27 is a side cross sectional view of a second embodiment of a draw latch according to the present invention, showing the latch in its closed position.
Figure 28:
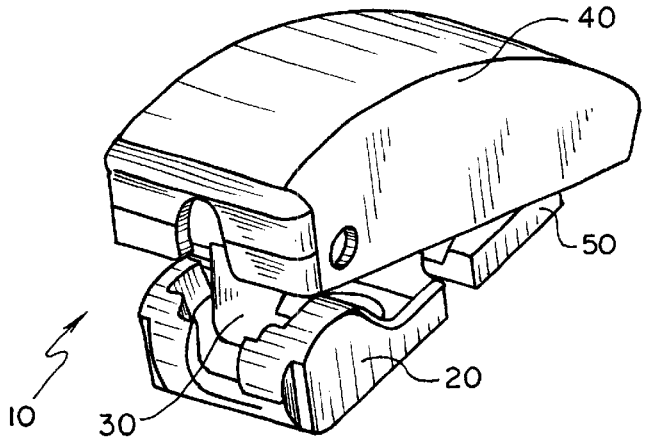
FIG. 28 is a perspective view of a third embodiment of a draw latch according to the present invention, showing the latch in its open position.
Figure 29:
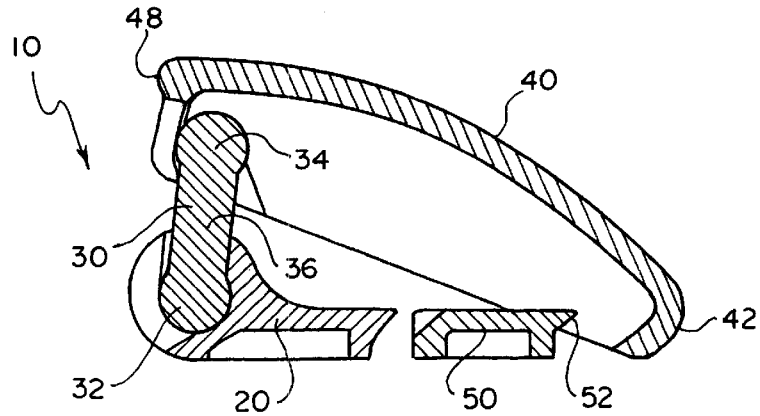
FIG. 29 is a side cross sectional view of a third embodiment of a draw latch according to the present invention, showing the latch in its open position.
Figure 30:
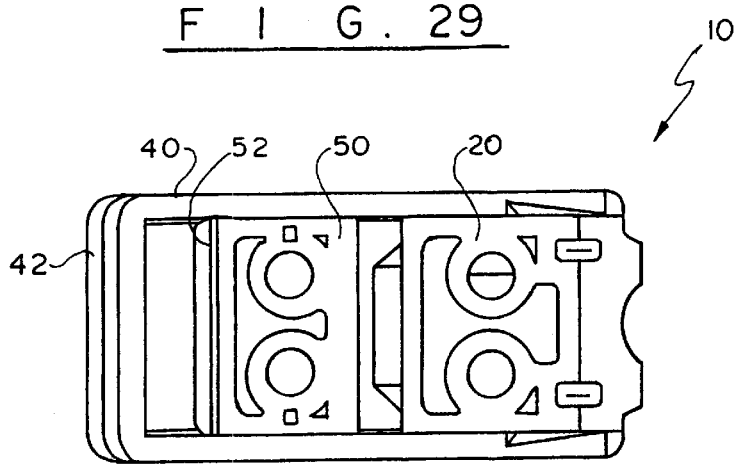
FIG. 30 is a bottom view of a third embodiment of a draw latch according to the present invention.

The operation of the second embodiment of the latch 10 is illustrated in FIGS. 23–27. Referring to FIGS. 26–27, the latch is illustrated in the closed position, wherein the hooked nose portion 42 of the housing 40 engages the lip 52 of the keeper. FIG. 27 clearly illustrates how the clevis' first end 32 is higher than the second end 34. The off center positioning of the clevis 30 will cause the force exerted on the housing 40 by the keeper 50 to maintain the latch 10 in its closed position. Secondly, the friction between the ribs 29,100 and the channels 39*a*,39*b* maintains the latch 10 in the closed position. Lastly, the arms 102 surrounding the shaft 36 of the clevis also retain the latch 10 in its closed position. In this position, the ramped surface 108 of the base bracket 20 and the ramped surface 110 of the keeper 50 abut each other.

The latch is opened by raising the housing's rear flange 48, thereby removing the clevis 20 from the arms 102. The latch 10 is moved to the position illustrated in FIGS. 23–25. In this position, the housing 40 has become disengaged from the keeper 50, thereby allowing the panel to which the keeper is secured to separate from the panel to which the base bracket 20 is secured. The latch 10 is retained in this position, or in any other position desired, by the friction between the ribs 29,100 and the channels 39*a*,39*b*.

To close the latch 10, the hooked nose portion 42 of the housing 40 is hooked over the lip 52 of the keeper, and the housing's flange 48 is rotated downward. The keeper 50 and base bracket 20 are thereby drawn together as the latch 10 is returned to the closed position described above.

A third embodiment of the latch is illustrated in FIGS. 28–32 and 36–41. This third embodiment of the latch 10 differs from the second embodiment only in that the base bracket 20 does not include the arms 102. As in the second embodiment, the third embodiment includes a base bracket 20, a clevis 30, a housing 40, and a keeper 50.

Referring to FIGS. 31–32, the housing 40 is illustrated. The housing includes a hooked nose portion 42, defining an inner radius 44. The housing's rear includes a slot 41, dimensioned and configured to contain a clevis 30, and a flange 48, dimensioned and configured to permit grasping the flange 48 to raise the housing 40. The rear portion of the housing 40 preferably also defines means for pivotally securing a clevis 30, preferably holes 45, which may include ramped surfaces 47 to facilitate snapping the clevis 30 into place. A rib 100 protrudes from the inside of the top of housing 10, illustrated in FIG. 32.

Figure 36:
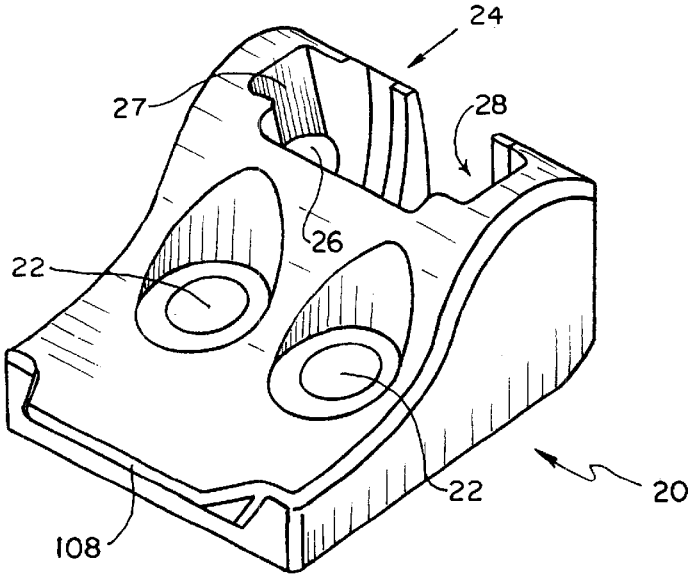
FIG. 36 is a perspective view of a base for a third embodiment of a draw latch according to the present invention.
Figure 37:
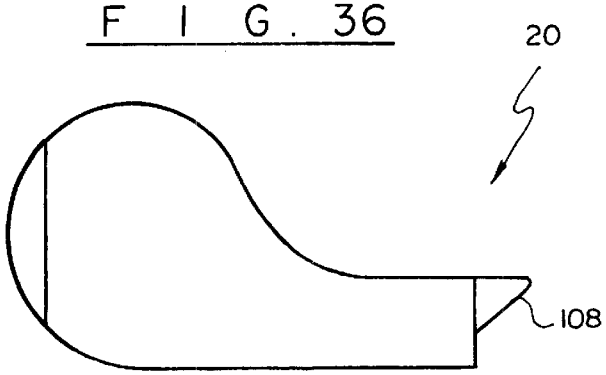
FIG. 37 is a side view of a base for a third embodiment of a draw latch according to the present invention.
Figure 38:
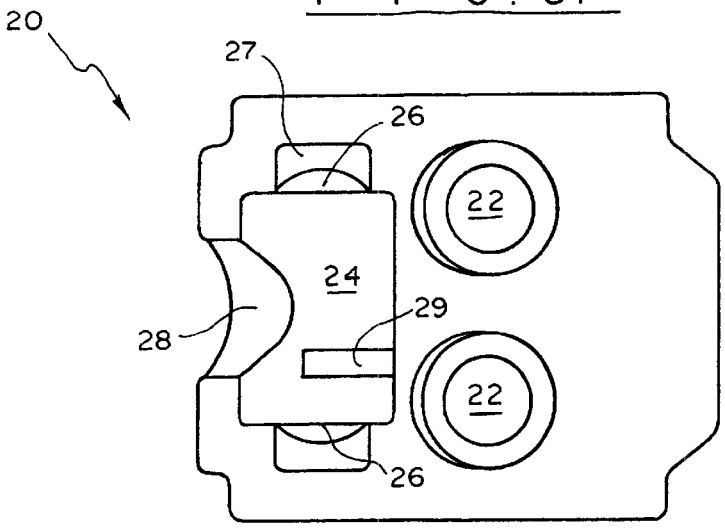
FIG. 38 is a bottom view of a base for a third embodiment of a draw latch according to the present invention.

The base bracket 20 is best illustrated in FIGS. 36–38. The base bracket 20 defines at least one hole 22, dimensioned and configured to receive mounting means such as the rivets 23, described above. The base bracket 20 also includes means for pivotally securing the clevis 30, preferably by defining an opening 24, having a hole or depression 26 on either side. A ramped surface 27 may extend from the top of the base bracket 20 to the holes 26, facilitating snapping in the clevis 30. A slot 28, communicating with the opening 24, is located at the rear of the base bracket 20 and is dimensioned and configured to receive the clevis 30. A rib 29 preferably protrudes into the opening 23. The base bracket 20 may also include a ramped front surface 108.

Referring to FIGS. 39–40, a clevis 30 is illustrated. The clevis 30 includes a first end 32, dimensioned and configured to pivotally attach to a base bracket 20, and a second end 34, dimensioned and configured to pivotally attach to the housing 40. A main longitudinal shaft 36 connects the ends 32,34. The first end 32 and second end 34 each include means for pivotally securing the clevis 30, which are preferably pegs 33. The pegs 33 preferably have a ramped surface 35 or curved surface 37 to facilitate snapping the clevis 30 into a base bracket 20 or housing 40. The first end may include a channel 39*a* dimensioned and configured to mate with the rib 29 of the base bracket 20. Likewise, the second end 34 may include a channel 39*b,* dimensioned and configured to mate with the rib 100 of the housing 40. The interaction between the ribs 29,100 and the channels 39*a*,39*b* creates friction, thereby securing the latch in any desired position.

Referring to FIGS. 41–42, a keeper 50 is illustrated. The keeper 50 includes a lip 52, dimensioned and configured to mate with the hooked nose portion 42 of the housing 40. The keeper also preferably includes a ramped surface 110, dimensioned and configured to abut the ramped front surface 108 of the base bracket 20 when the latch 10 is closed. The keeper 50 may include at least one mounting hole 112.

The operation of the second embodiment of the latch 10 is illustrated in FIGS. 26 and 28–30. Referring to FIG. 26, the latch is illustrated in the closed position, wherein the hooked nose portion 42 of the housing 40 engages the lip 52 of the keeper. Like the second embodiment of FIG. 27, the clevis' first end 32 is higher than the second end 34. The off center positioning of the clevis 30 will cause the force exerted on the housing 40 by the keeper 50 to maintain the latch 10 in its closed position. Secondly, the friction between the ribs 29,100 and the channels 39*a*,39*b* maintains the latch 10 in the closed position. In this position, the ramped surface 108 of the base bracket 20 and the ramped surface 110 of the keeper 50 abut each other.

The latch is opened by raising the housing's rear flange 48. The latch 10 is moved to the position illustrated in FIGS. 28–30. In this position, the housing 40 has become disengaged from the keeper 50, thereby allowing the panel to which the keeper is secured to separate from the panel to which the base bracket 20 is secured. The latch 10 is retained in this position, or in any other position desired, by the friction between the ribs 29,100 and the channels 39*a*,39*b*.

To close the latch 10, the hooked nose portion 42 of the housing 40 is hooked over the lip 52 of the keeper, and the housing's flange 48 is rotated downward. The keeper 50 and base bracket 20 are thereby drawn together as the latch 10 is returned to the closed position described above.

It will be recognized by those skilled in the art that changes may be made in the above described embodiment of the invention without departing from the broad inventive concepts thereof. It is understood, therefore, that this invention is not limited to the particular embodiment disclosed, but is intended to cover all modifications which are within the scope and spirit of the invention as defined by the appended claims.

What is claimed is:

1. A draw latch for latching together two closure members, said draw latch having an open and a closed position, said draw latch comprising:

a keeper for securing to one of the closure members;

a base bracket for attaching to the other of the closure members;

a housing having a first end and a second end, the first end of the housing pivotally and detachably connected to the keeper;

a clevis having a first and a second end, the first end of the clevis pivotally secured to the base bracket, and the second end of the clevis pivotally secured to the second end of the housing; and said base defining a vertical slot having a narrowed portion matable to said clevis, said narrowed portion acting as a detent such that said clevis snaps into place in said slot to retain said draw latch in its latched position.

2. A draw latch for latching together two closure members, said draw latch having an open and a closed position, said draw latch comprising:

a keeper for securing to one of the closure members;

a base bracket for attaching to the other of the closure members;

a housing having a first end and a second end, the first end of the housing pivotally and detachably connected to the keeper;

a clevis having a first and a second end, the first end of the clevis pivotally secured to the base bracket and defining a channel, and the second end of the clevis pivotally secured to the second end of the housing and also defining a channel;

said base bracket including a rib dimensioned and configured to mate with said channel within said first end of said clevis; thereby creating friction; and said housing including a rib dimensioned and configured to mate with said channel within said second end of said clevis, thereby creating friction.

3. The draw latch according to claim 2, wherein said base defining a vertical slot having a narrowed portion matable to said clevis, said narrowed portion acting as a detent such that said clevis snaps into place in said slot to retain said draw latch in its latched position.

* * * * *

UNITED STATES PATENT AND TRADEMARK OFFICE

CERTIFICATE OF CORRECTION

PATENT NO. : 6,457,750 B1
DATED : October 1, 2002
INVENTOR(S) : William E. Sokurenko et al.

It is certified that error appears in the above-identified patent and that said Letters Patent is hereby corrected as shown below:

Column 3,
Line 26, Fig. 39, replace “levis” with -- clevis --.

Signed and Sealed this

Sixth Day of April, 2004

JON W. DUDAS
*Acting Director of the United States Patent and Trademark Office*